United States Patent [19]

Hartmann

[11] 3,931,376

[45] Jan. 6, 1976

[54] METHOD FOR ROLLING OUT A BAR-SHAPED PRE-MOLDING OF CERAMIC MATERIAL TO FORM A PLATE

[75] Inventor: Jochen Hartmann, Schwarzenfeld, Germany

[73] Assignee: Fetok GmbH, Chur, Switzerland

[22] Filed: May 6, 1971

[21] Appl. No.: 140,845

[30] Foreign Application Priority Data

May 6, 1970 Germany ..... 2022354

[52] U.S. Cl. ..... 264/22; 264/320; 264/334

[51] Int. Cl.[2] ..... B28B 3/12

[58] Field of Search ..... 264/22, 24, 334, 320

[56] References Cited

UNITED STATES PATENTS 3,705,112 12/1972 Neinart ..... 264/332

FOREIGN PATENTS OR APPLICATIONS 842,129 5/1970 Canada ..... 264/63

1,216,027 12/1970 United Kingdom ..... 264/56

OTHER PUBLICATIONS

"Dictionary of Ceramics," A. E. Dodd, 1964, p. 53 and p. v.

Popper (Editor), *Special Ceramics*, 1964, (1965), p. 243, (British Ceramic Research Association).

American Ceramic Society, *Ceramics Abstracts*, (1964), pp. 250–251.

*Primary Examiner*—Robert F. White

*Assistant Examiner*—T. E. Balhoff

*Attorney, Agent, or Firm*—Schuyler, Birch, Swindler, McKie & Beckett

[57] ABSTRACT

A rolling apparatus for ceramic material comprises a smooth upper roll and rough lower roll for rolling a bar-shaped premolding out into a plate. The premolding is arranged to become attached to the upper roll and travel round with it, possibly more than once. When the plate comes into the gap between the rolls for the last time the upper roll is made negative electrically with respect to the lower roll.

1 Claim, 1 Drawing Figure

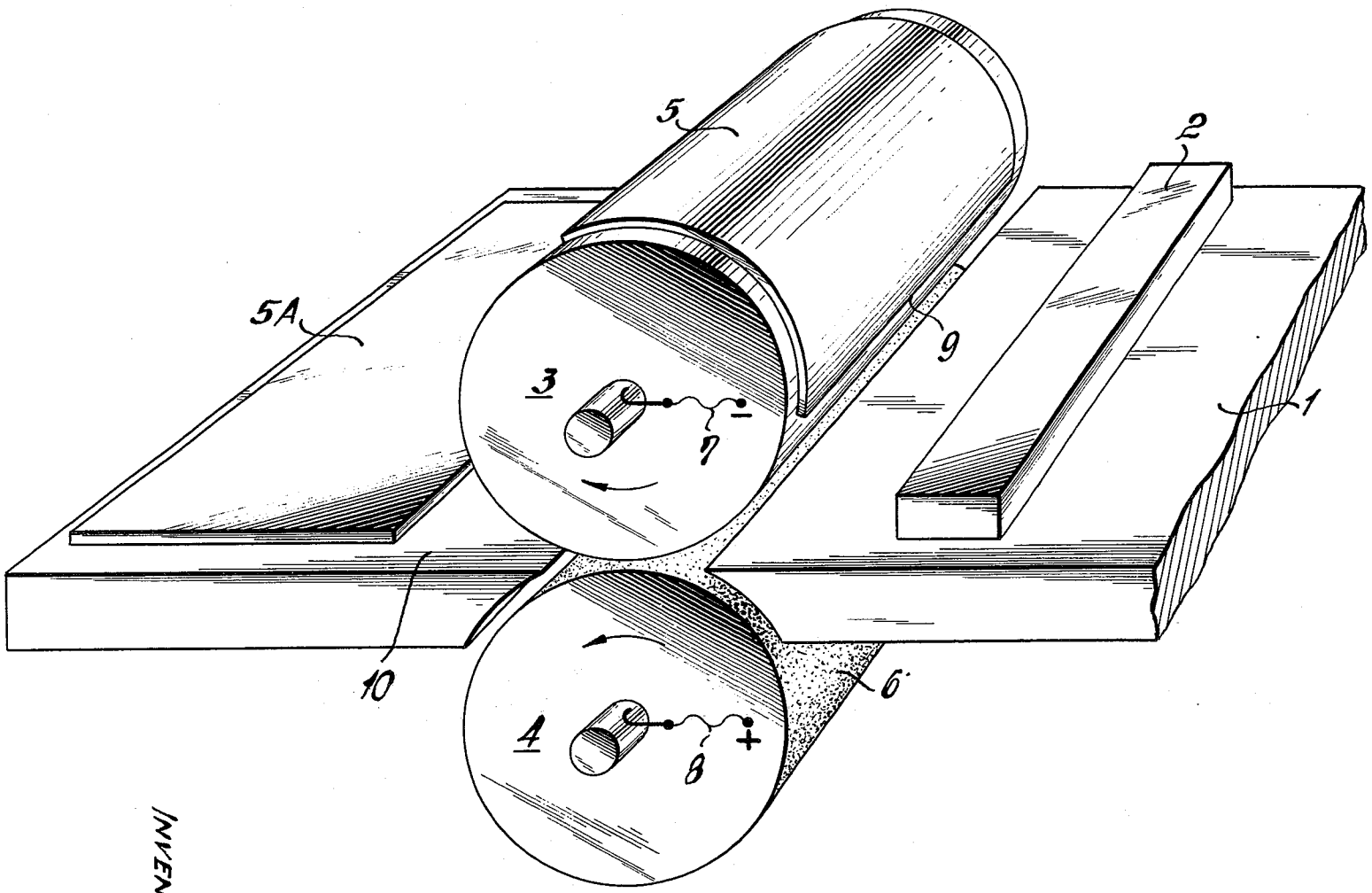
INVENTOR

METHOD FOR ROLLING OUT A BAR-SHAPED PRE-MOLDING OF CERAMIC MATERIAL TO FORM A PLATE

The invention relates to methods for rolling out bar-shaped premoldings of ceramic materials to form thin plates by means of rolls whose nip determines the thickness of the plate.

It has already been recognised that in the case of demolding ceramic materials in two mold halves application of an electric field to the upper and the lower mold provides advantages. Thus the method of the German Specification 69,672 involves the application of an electric current to avoid the adhesion of moist materials on the molds. Furthermore a proposal has already been made in connection with the rolling out of a strip-like structure, possibly of indefinite length, between two rolls whose nip size determines the thickness of the rolled out material, to apply an electric field between the upper and the lower roll with the lower roll positive and the upper roll negative. In the case of this method as well it is, however, necessary to carry out the calibration of the rolled product to size in a following pair of rolls and thus to pay attention again to the correct application of the electric field.

One aim of the invention is to provide a method in which it is possible to roll out material and to calibrate it to size with one and the same pair of rolls. In this case the principle of the application of an electric field is used in a particular fashion.

The present invention consists in a method for rolling out a bar-shaped premolding of ceramic material to form a thin plate, comprising passing the premolding through the nip of a pair of rolls, of which the upper roll is smooth and the lower roll is rough, and the ceramic material adhers to the upper roll and travels round with it at least for one revolution and then applying an electric field to the rolls so that the upper roll becomes negative in relation to the lower roll for detaching the material from the upper roll.

The invention makes a particularly advantageous use of the fact that ceramic materials adhere to smooth surfaces and simultaneously uses the principle of detachment by the application of an electric field which brings the adhesion force when the rolling operation is regarded as being finished.

Thus in the case of the method in accordance with the invention it is not necessary to use a calibrating rolling apparatus in order to achieve the desired smooth upper surface and the lower rough surface. The whole rolling operation is carried out with one pair of rolls, it only being necessary to apply the electric field at the correct time.

The single figure of the drawing shows an apparatus diagramatically with which the method in accordance with the invention can be carried out.

On the table 1, which is provided with suitable advancing and conveying devices omitted for the sake of clarity in the drawing, premoldings 2 follow one another in succession. They have the form of a usual bar or billet and consist of the ceramic material. These premoldings 2 or billets are rolled out between the upper roll 3 and the lower roll 4, whose direction of rotation is shown by the arrows.

If no electric field is applied to the upper and lower roll, the rolled out molding 5 becomes attached to the upper roll 3 provided with a smooth surface and remains on it until it is detached. The lower roll 4 has a rough surface as indicated by reference numeral 6.

Detachment is carried out in a simple manner by applying an electric field between the two current terminals 7 and 8 as is indicated in the drawing so that the upper roll 3 becomes negative owing to the terminal 7, connected with it, while the positive or plus pole of the field our source is connected with the terminal 8 and thus with the lower roll 4. If this field is applied just at that point in time in which the front edge 9 of the plate-like structure 5 reaches the roll nip, the surface of the plate-like structure 5 which has up till now been attached to the smooth surface of the roller 3 becomes detached from the latter and the plate-like structure 5 moves along the table 10, which is also provided with suitable conveying devices so that the plate-like structure, now denoted by reference numeral 5A is conveyed out of the rolling apparatus.

I claim:

1. A method for rolling out bar-shaped premolding of ceramic material to form a thin plate, comprising passing the premolding through the nip of a pair of rolls, of which the upper roll is smooth and the lower roll is rough, allowing the ceramic material to adhere to the upper roll and travel round with it for at least one revolution and then detaching the ceramic material from the upper roll by applying an electric field to the rolls so that the upper roll becomes negative in relation to the lower roll, said electric field being of sufficient intensity to detach said material from said upper roll and said ceramic material being a ceramic material capable of being detached fromm said smooth roll by the application of said electric field.

* * * * *